US007166195B2

(12) United States Patent
Hawes

(10) Patent No.: US 7,166,195 B2
(45) Date of Patent: Jan. 23, 2007

(54) GROOVED AND PERFORATED LAYER FOR USE IN PAPERMAKERS' FABRIC

(75) Inventor: John Hawes, Averill Park, NY (US)

(73) Assignee: Albany International Corp., Albany, NY (US)

( * ) Notice: Subject to any disclaimer, the term of this patent is extended or adjusted under 35 U.S.C. 154(b) by 167 days.

(21) Appl. No.: 10/619,393

(22) Filed: Jul. 15, 2003

(65) Prior Publication Data

US 2005/0013969 A1 Jan. 20, 2005

(51) Int. Cl.
*D21F 7/08* (2006.01)
*B32B 5/06* (2006.01)
*B32B 27/12* (2006.01)

(52) U.S. Cl. ..... 162/358.2; 162/900; 428/131; 428/137; 428/167; 428/169; 442/270; 442/286; 442/394

(58) Field of Classification Search ..... 162/203–207, 162/306, 348, 358.1, 358.2, 358.4, 900–904; 139/383 A, 425 A; 100/37; 428/131–138, 428/152–154, 156, 163, 167, 169; 442/268–270, 442/286, 394
See application file for complete search history.

(56) References Cited

U.S. PATENT DOCUMENTS

| | | | | |
|---|---|---|---|---|
| 1,925,917 | A * | 9/1933 | Chalon | 428/132 |
| 3,549,742 | A * | 12/1970 | Benz | 264/250 |
| 4,446,187 | A | 5/1984 | Eklund | |
| 4,537,658 | A * | 8/1985 | Albert | 162/348 |
| 4,541,895 | A * | 9/1985 | Albert | 162/348 |
| 4,752,519 | A | 6/1988 | Boyer et al. | |
| 5,134,010 | A | 7/1992 | Schiel | |
| 5,167,771 | A | 12/1992 | Sayers et al. | |
| 5,330,604 | A | 7/1994 | Allum et al. | |
| 5,342,486 | A | 8/1994 | Jeffery et al. | |
| 5,501,775 | A | 3/1996 | Kotitschke et al. | |
| 5,508,095 | A | 4/1996 | Allum et al. | |
| 5,520,782 | A | 5/1996 | Schiel | |
| 5,914,007 | A | 6/1999 | Henssler et al. | |
| 6,029,570 | A | 2/2000 | Matuschczyk | |
| 6,193,847 | B1 * | 2/2001 | Trokhan | 162/358.1 |
| 6,514,386 | B1 * | 2/2003 | Watanabe | 162/358.2 |
| 6,544,389 | B1 * | 4/2003 | Johnson | 162/348 |
| 6,726,809 | B1 * | 4/2004 | Joyce et al. | 162/358.1 |

FOREIGN PATENT DOCUMENTS

| | | |
|---|---|---|
| EP | 0 881 327 A | 12/1998 |
| GB | 891860 | 3/1962 |
| GB | 1 598 948 | 9/1981 |
| WO | WO 91/14558 | 10/1991 |
| WO | WO 92/17643 | 10/1992 |
| WO | WO 98/01618 | 1/1998 |
| WO | WO 98/21403 | 5/1998 |
| WO | WO 98/56982 | 12/1998 |

* cited by examiner

*Primary Examiner*—Eric Hug
(74) *Attorney, Agent, or Firm*—Frommer Lawrence & Haug LLP; Ronald R. Santucci

(57) ABSTRACT

A grooved perforated layer for use in a papermakers' fabric is provided. The grooves serve to diffuse flow at the surface of the perforated layer so as to reduce the pressure drop across the layer and thereby reduce the migration of fines. In this manner, the light/dark pattern associated with the fines is avoided and the quality of the resulting paper sheet is improved.

39 Claims, 1 Drawing Sheet

GROOVED AND PERFORATED LAYER FOR USE IN PAPERMAKERS' FABRIC

BACKGROUND OF THE INVENTION

1. Field of the Invention

The present invention relates to the papermaking arts. More specifically, the present invention relates to press fabrics for the press section of a paper machine.

2. Description of the Prior Art

The production of paper begins with the processing of wood. Wood is chiefly composed of two major substances, cellulose and lignin; both are organic, that is, their molecules are built around chains and rings of carbon atoms. Cellulose occurs in the walls of the plant cells and is the fibrous material that is used to make paper. Lignin is a large complex molecule that acts as a kind of glue that holds the cellulose fibers together and stiffens the cell walls, giving wood its mechanical strength. In order to convert wood into pulp suitable for making paper, the cellulose fibers must be freed from the lignin.

During the papermaking process, a cellulosic fibrous web is formed by depositing a fibrous slurry, that is, an aqueous dispersion of the cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to perform this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needle-punched a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the press fabric may be formed of several layers. For example, the fabric may include a woven base and an intermediate layer that are laminated together. One such fabric is the Albany International Apertech™ press fabric, which includes a woven base fabric and a polymeric layer. The polymeric layer of the Apertech™ fabric is perforated and is illustrated in FIG. 1. FIG. 1 is a plan view of the paper side of the polymeric layer, in which the polymeric layer is generally indicated by reference numeral 1 and the perforations by reference numeral 4. As can be seen from the figure, surface 1 is smooth and the perforations are evenly distributed across the surface.

The present invention relates primarily to an improvement in a perforated layer of a papermakers' fabric, such as the layer used in the Apertech™ fabric.

SUMMARY OF THE INVENTION

The inventor of the present invention has recognized that in some applications of a papermakers' fabric with a perforated layer, the hole pattern of the perforated layer is replicated in the paper sheet. The inventor has further recognized that such marking is caused by collections of fines having a relatively high density of lignin in the paper web. More specifically, hole pattern replication in the paper is due to fluid flow concentrations through the holes which cause migration of fines and their associated lignin which give rise to light/dark contrasting areas in the paper.

In view of the drawback caused in certain applications by the perforated layer of a papermakers' fabric, it is an object of the invention to diffuse flow at the surface of the perforated layer so as to reduce the pressure drop across the layer and thereby reduce flow concentration through the holes and hence the migration of fines in the paper web. To realize this objective, a grooved perforated layer is provided. The grooves serve to diffuse flow and reduce the migration of fines so that the light/dark pattern associated with the fines is avoided and the quality of the resulting paper sheet is improved.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

A preferred embodiment of the present invention will be described in the context of papermaking press fabrics. However, it should be noted that the invention is applicable to fabrics used in other sections of a paper machine, as well as to those used in other industrial settings where diffusion of flow across a surface of a fabric improves the fabric's performance.

Some examples of other fabric types to which the invention is applicable include papermakers' forming fabrics, papermakers' dryer fabrics, through-air-drying fabrics and pulp forming fabrics. Another example of a fabric type to which the invention is applicable is engineered fabrics, such as fabrics used in making non-woven textiles in the wetlaid, drylaid, meltblown and/or spun bonding processes.

Figure 1:
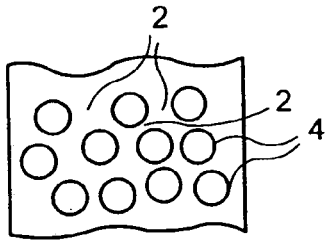
FIG. 1 PRIOR ART
FIG. 1 is a plan view of a related art perforated layer of a papermakers' fabric.
Figure 2:
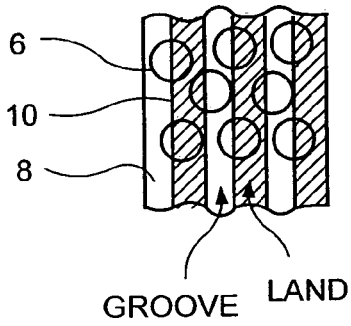
FIG. 2 is a plan view of a perforated layer according to one embodiment of the invention.

FIG. 2 is a plan view of a section of a perforated layer in accordance with the invention. As can be seen from FIG. 2, the layer includes a multiple of land areas 10, a multiple of groove areas 8 and a multiple of perforations 6. The groove areas lie in a plane below the plane in which the land areas lie. A cross-section of the layer is shown in FIG. 5.

Figure 5:
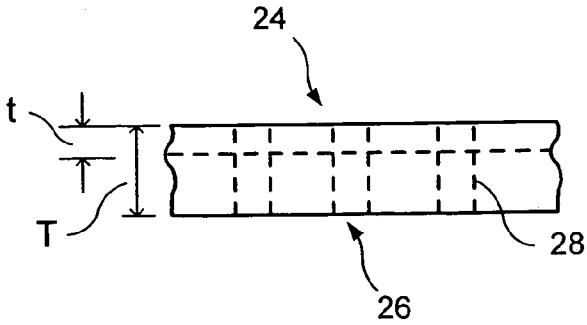
FIG. 5 is a cross-sectional view of a perforated layer according to the invention.

Referring to FIG. 5, it can be seen that the plane of the groove areas lies a distance "t" below top surface 24 of the layer. The plane of the groove areas defines the groove depth. As can be seen, the groove depth is equal to about one-quarter of the overall thickness "T" of the layer—the overall thickness being defined as the distance from the top surface, defining the plane of the lands, to the bottom surface 26. For purposes of clarity of presentation, only three perforations 28 are shown in FIG. 5.

It should be noted that the groove depth is not limited to being about equal to one-quarter of the overall thickness, but may be varied according to the material(s) used to form the layer and the desired properties of the finished layer. It is also noted that, although the grooves have been described as having uniform depth, an alternative embodiment includes grooves of varying depth, in which case the groove areas would not all lie in a single plane parallel to a surface plane. That is, in the alternative embodiment, the groove areas do not lie in a plane, or lie in a plane that is not parallel to either the top surface plane or bottom surface plane. Furthermore, it is possible to vary the height of the land areas such that the top surface of the layer has an uneven construction and the land areas no longer lie in a single plane. Still further, it is noted that in the FIG. 2 embodiment, some perforations lie partly in a groove and partly in a land. It is possible to form the layer such that each perforation lies either entirely in a groove or entirely in a land, with no perforation lying across a land/groove interface. In any event, the perforations may be formed either before or after grooves are formed.

It is also conceivable that the grooves can be at an angle with the machine direction. Furthermore, there can be two series of grooves at an angle to each other in a cross hatch pattern.

Figure 3:
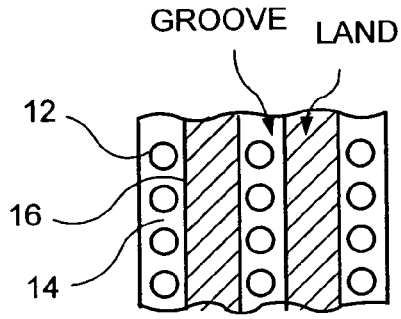
FIG. 3 is a plan view of a perforated layer according to another embodiment of the invention.

FIG. 3 is a plan view of a section of a perforated layer in accordance with another embodiment of the invention. As can be seen from FIG. 3, all perforations 12 are confined to groove areas 14 and no perforation lies in any land area 16. In the FIG. 3 embodiment, all of the variations discussed in connection with the FIG. 2 embodiment are applicable, with the exception of the variations regarding placement of the perforations.

Figure 4:
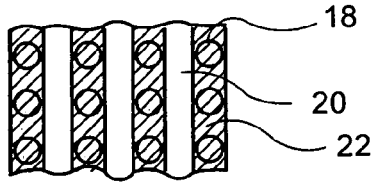
FIG. 4 is a plan view of a perforated layer according to still another embodiment of the invention.

FIG. 4 is a plan view of a section of a perforated layer in accordance with still another embodiment of the invention. As can be seen from FIG. 4, all perforations 18 are confined to land areas 22 and no perforation lies in any groove area 20. All of the variations discussed in connection with the FIG. 2 embodiment are applicable to the FIG. 4 embodiment, with the exception of the variations regarding placement of the perforations.

Regardless of embodiment, it is preferable to combine the grooved and perforated layer of the invention with other layers in order to realize a papermakers' press fabric. For example, the grooved and perforated layer of the invention may be substituted for the perforated layer of the Apertech™ fabric to thereby construct a "grooved Apertech™."

In any embodiment, the invention diffuses flow at the surface of a perforated layer of a papermakers' fabric. The diffusion of flow reduces the pressure drop across the layer and thereby reduces the migration of fines which has the effect of reducing/avoiding the light/dark pattern that such migration imparts to the paper sheet.

Modifications to the present invention would be obvious to those of ordinary skill in the art in view of this disclosure, but would not bring the invention so modified beyond the scope of the appended claims.

What is claimed is:

1. A layer for use in a papermakers' fabric, comprising:

a plurality of land areas;

a plurality of groove areas;

a plurality of perforations extending from a top surface to a bottom surface of said layer; and wherein the combination of said land areas, groove areas and perforations minimize pattern formation on said paper sheet.

2. A layer as claimed in claim 1 wherein said groove areas lie in a plane.

3. A layer as claimed in claim 1 wherein said land areas lie in a plane.

4. A layer as claimed in claim 1 wherein said groove areas lie in a plane and said land areas lie in a plane.

5. A layer as claimed in claim 4 wherein said plane of said groove areas and said plane of said land areas are parallel.

6. A layer as claimed in claim 1 which includes a series of groove areas, some of which are positioned at an angle greater than 0 degrees to a machine direction.

7. A layer as claimed in claim 6 wherein said series of groove areas are in a cross hatched pattern.

8. A layer as claimed in claim 1 wherein said perforations are dispersed throughout both said land areas and said groove areas, and wherein one or more of said perforations lies across the interface of a land area and a groove area.

9. A layer as claimed in claim 1 wherein said perforations are only in said groove areas.

10. A layer as claimed in claim 1 wherein said perforations are only in said land areas.

11. A method of forming a layer for use in a papermakers' fabric, comprising the steps of:

forming a plurality of grooves in a base material so as to form a modified base material having a plurality of land areas and a plurality of groove areas; and perforating said modified base material so as to form a plurality of perforations extending from a top surface to a bottom surface in said modified base material, wherein the combination of said land areas, groove areas and perforations minimize pattern formation on said paper sheet.

12. A method as claimed in claim 11 wherein said groove areas lie in a plane.

13. A method as claimed in claim 11 wherein said land areas lie in a plane.

14. A method as claimed in claim 11 wherein said groove areas lie in a plane and said land areas lie in a plane.

15. A method as claimed in claim 14 wherein said plane of said groove areas and said plane of said land areas are parallel.

16. A method as claimed in claim 11 which includes a series of groove areas, some of which are positioned at an angle greater than 0 degrees to a machine direction.

17. A method as claimed in claim 16 wherein said series of groove areas are in a cross hatched pattern.

18. A method as claimed in claim 11 wherein said perforations are dispersed throughout both said land areas and said groove areas, and wherein one or more of said perforations lies across the interface of a land area and a groove area.

19. A method as claimed in claim 11 wherein said perforations are only in said groove areas.

20. A method as claimed in claim 11 wherein said perforations are only in said land areas.

21. A layer for use in a papermakers' fabric formed by creating a plurality of grooves in a base material so as to form a modified base material having a plurality of land areas and a plurality of groove areas, and perforating said modified base material so as to form a plurality of perforations extending from a top surface to a bottom surface in said modified base material, wherein the combination of said land areas, groove areas and perforations minimize pattern formation on said paper sheet.

22. A layer as claimed in claim 21 wherein said groove areas lie in a plane.

23. A layer as claimed in claim 21 wherein said land areas lie in a plane.

24. A layer as claimed in claim 21 wherein said groove areas lie in a plane and said land areas lie in a plane.

25. A layer as claimed in claim 24 wherein said plane of said groove areas and said plane of said land areas are parallel.

26. A layer as claimed in claim 21 which includes a series of groove areas, some of which are positioned at an angle greater than 0 degrees to a machine direction.

27. A layer as claimed in claim 26 wherein said series of groove areas are in a cross hatched pattern.

28. A layer as claimed in claim 21 wherein said perforations are dispersed throughout both said land areas and said groove areas, and wherein one or more of said perforations lies across the interface of a land area and a groove area.

29. A layer as claimed in claim 21 wherein said perforations are only in said groove areas.

30. A layer as claimed in claim 21 wherein said perforations are only in said land areas.

31. A press fabric claimed in claim 25 wherein said perforations are only in said land areas.

32. A papermakers' press fabric, comprising a layer having:

a plurality of land areas oriented substantially in the machine direction;

a plurality of groove areas oriented substantially in the machine direction;

a plurality of perforations, extending from a top surface to a bottom surface of said layer; and wherein the combination of said land areas, groove areas and perforations minimize pattern formation on said paper sheet.

33. A press fabric as claimed in claim 32 wherein said groove areas lie in a plane.

34. A press fabric as claimed in claim 32 wherein said land areas lie in a plane.

35. A press fabric as claimed in claim 32 wherein said groove areas lie in a plane and said land areas lie in a plane.

36. A press fabric as claimed in claim 35 wherein said plane of said groove areas and said plane of said land areas are parallel.

37. A layer as claimed in claim 32 wherein said series of groove areas are in a cross hatched pattern.

38. A press fabric as claimed in claim 32 wherein said perforations are dispersed throughout both said land areas and said groove areas, and wherein one or more of said perforations lies across the interface of a land area and a groove area.

39. A press fabric claimed in claim 32 wherein said perforations are only in said groove areas.

* * * * *